United States Patent [19]

Cross et al.

[11] 3,973,769

[45] Aug. 10, 1976

[54] COMPACT SORTING APPARATUS

[75] Inventors: Thomas R. Cross, Rochester; Clifford L. George, Macedon, both of N.Y.

[73] Assignee: Xerox Corporation, Stamford, Conn.

[22] Filed: Dec. 9, 1974

[21] Appl. No.: 530,908

[52] U.S. Cl. ..... 271/173; 271/200

[51] Int. Cl.[2] ..... B65H 31/24

[58] Field of Search ..... 271/64, 173, 200; 270/58

[56] References Cited

UNITED STATES PATENTS

| | | | |
|---|---|---|---|
| 3,514,095 | 5/1970 | Hoff | 270/58 |
| 3,709,492 | 1/1973 | Baker et al. | 271/173 |
| 3,774,906 | 11/1973 | Fagan et al. | 270/58 |
| 3,848,868 | 11/1974 | Stemmle | 270/58 |

*Primary Examiner*—John J. Love
*Assistant Examiner*—Robert Saifer

[57] ABSTRACT

A compact sheet sorting apparatus having a first modular assembly which includes a plurality of bins and a second modular assembly which includes a sheet transport for transporting sheets along the inlets of the bins. The second modular assembly is juxtaposed with the first assembly and is pivotally mounted to move from a first position when in a sorting mode of operation to a second position opened away from the first assembly to provide access thereto.

4 Claims, 7 Drawing Figures

COMPACT SORTING APPARATUS

This invention relates in general to sheet sorting apparatus and in particular to a compact modular sorter for sorting copy sheets fed into the apparatus from electrostatographic printing machines. The instant application incorporates by reference U.S. Pat. No. 3,567,214 issued on Mar. 2, 1971 on a document feeder commonly assigned herewith.

Prior art sorters have encountered increasing demands in the sorting of copy sheets fed from high speed electrostatographic printing machines. Many of the prior art sorting devices are in the form of modules which are added on to the printing machine in sufficient numbers to accommodate the job requirements as described, for example, in U.S. Pat. Nos. 3,638,937, 3,774,906 and 3,802,694. While these prior art copying devices are satisfactory for handling a variety of job loads, they are not entirely suitable for compact spacing while enabling ease of access to sorter components to clear jams, etc.

It is an object of this invention to improve sorting apparatus used with copier/duplicator machines.

It is a further object of this invention to improve the production of collated copy sets printed by a copying machine.

It is another object of this invention to provide a compact modular design for a sorting apparatus.

It is another object of this invention to provide sorting apparatus easily accessible to clear jams and the like.

These and other objects of the instant invention are achieved generally speaking by arranging a first modular assembly with copy bins juxtaposed with a second modular assembly having a sheet transport and adapted for pivotal movement relative to the first assembly.

For a better understanding of the invention as well as other objects and further features thereof, reference is had to the following detailed description of the invention which is to be read in conjunction with the accompanying drawings wherein.

Figure 4:
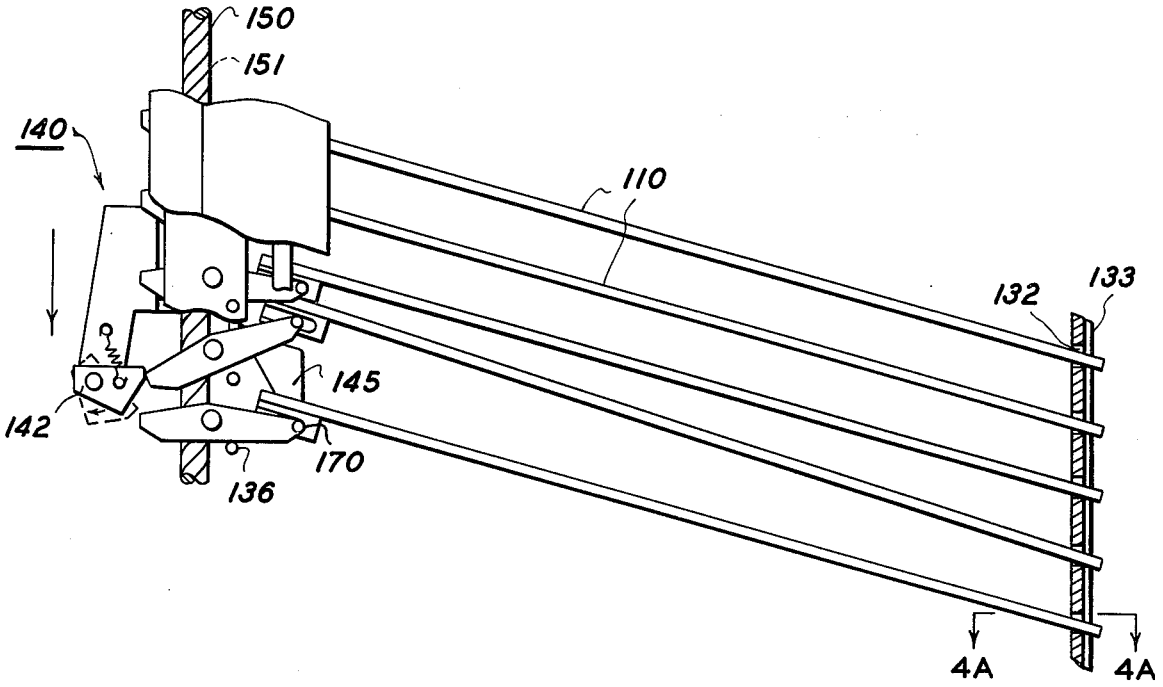
FIG. 4 is an exploded view of the sheet distributing mechanism and the sorting bins.
Figure 4A:
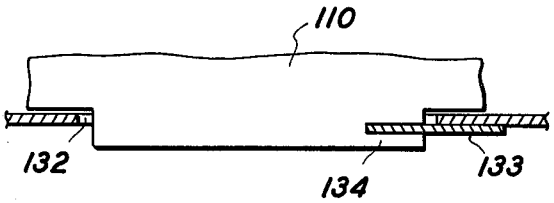

FIG. 4*a* is a sectional view of the pivot mounting of a sorting bin of FIG. 4 taken along line 4*a* — 4*a;*

Figure 5:
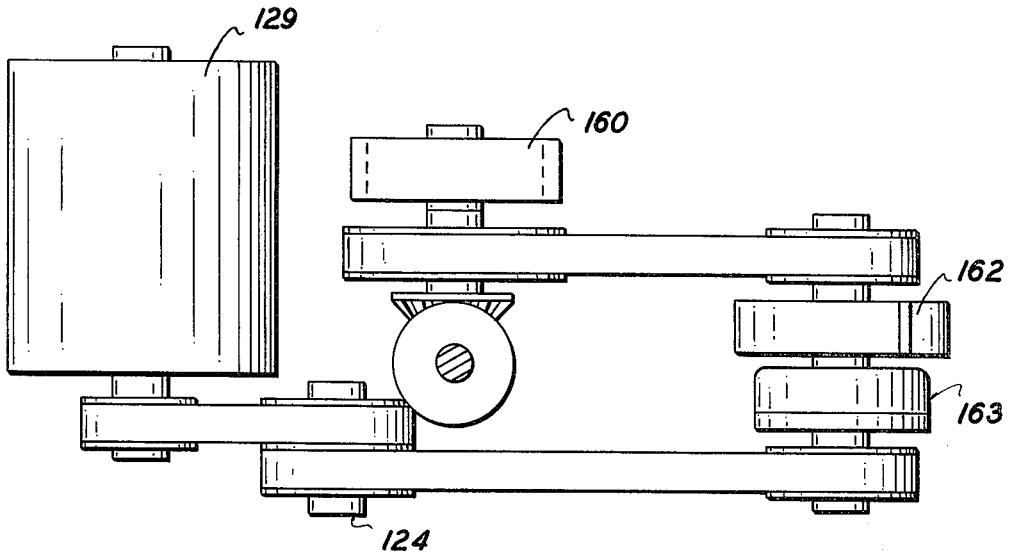
Figure 6:
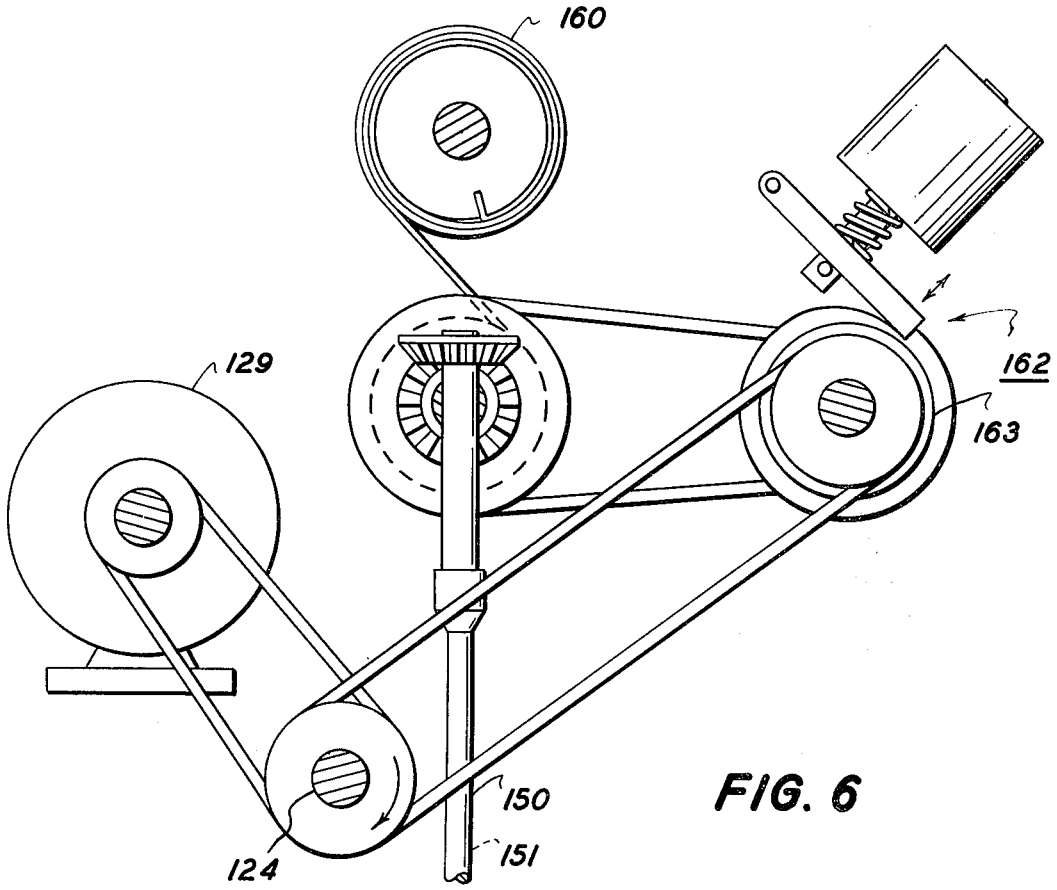

FIG. 5 is a top view of the drive for the sheet distributing mechanism of the sorting apparatus; and FIG. 6 is an elevation of the drive.

Figure 1:
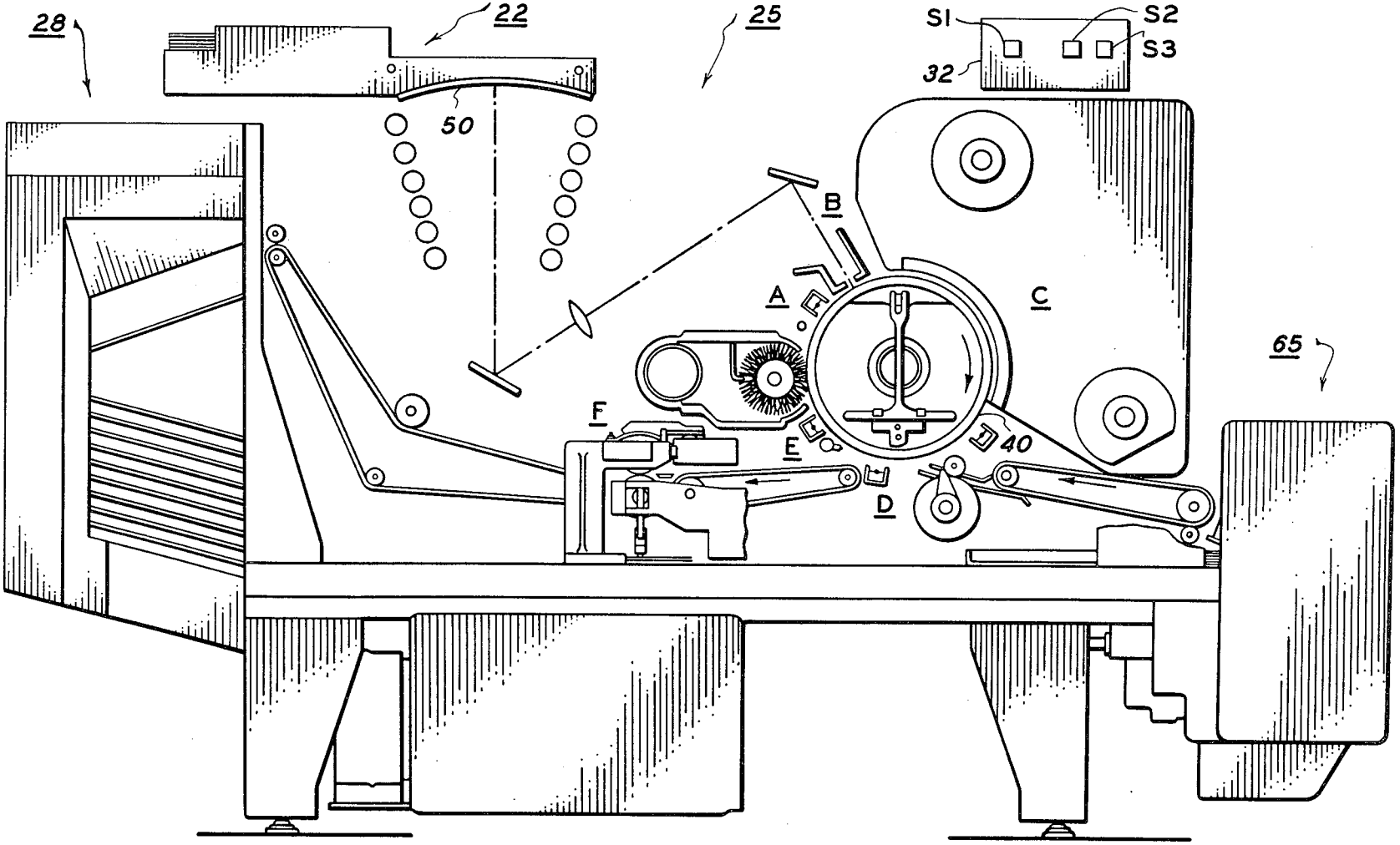
FIG. 1 illustrates schematically electrostatographic reproducing system including sorting apparatus in accordance with the instant invention.
Figure 2:
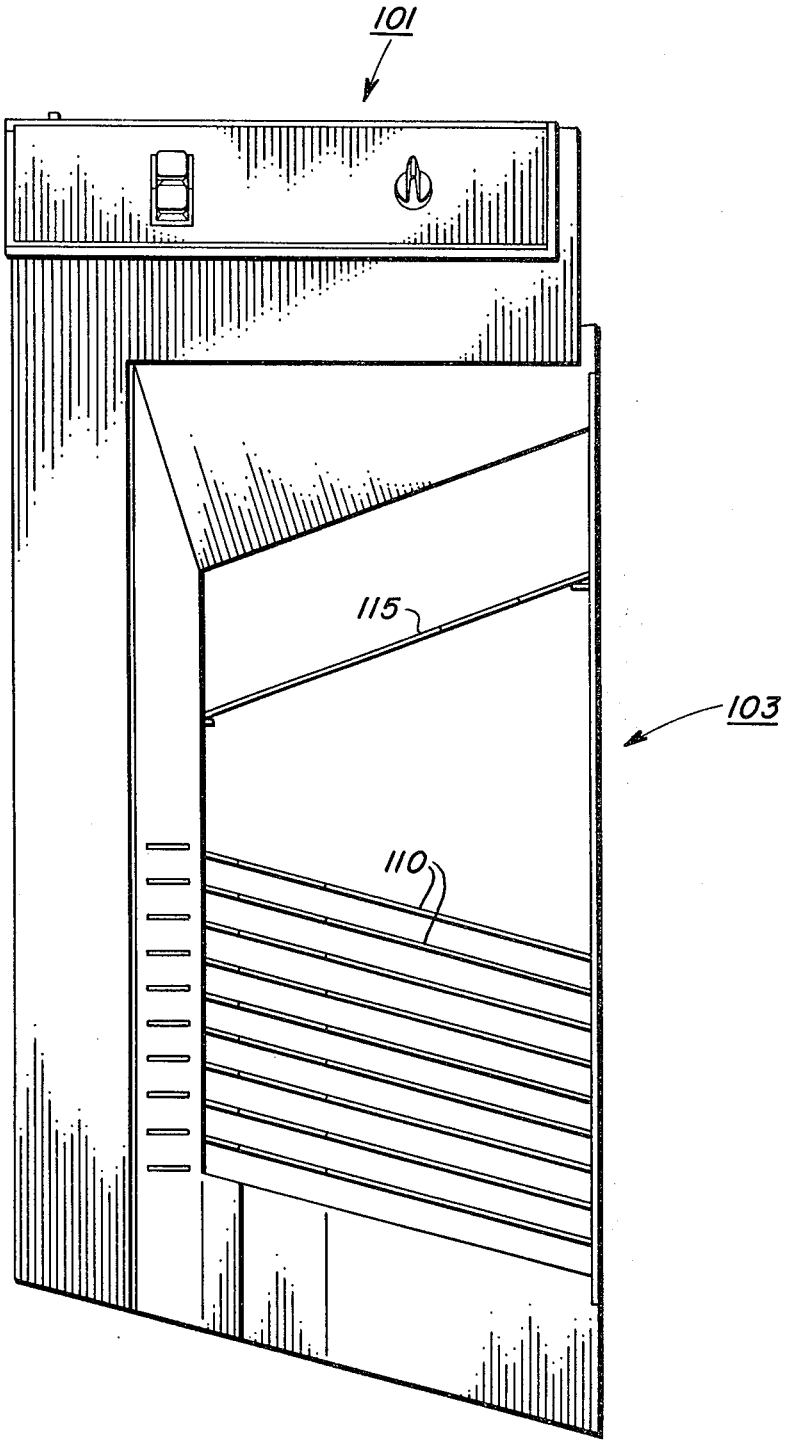
FIG. 2 is a side elevational view of the sorting apparatus according to the invention.
Figure 3:
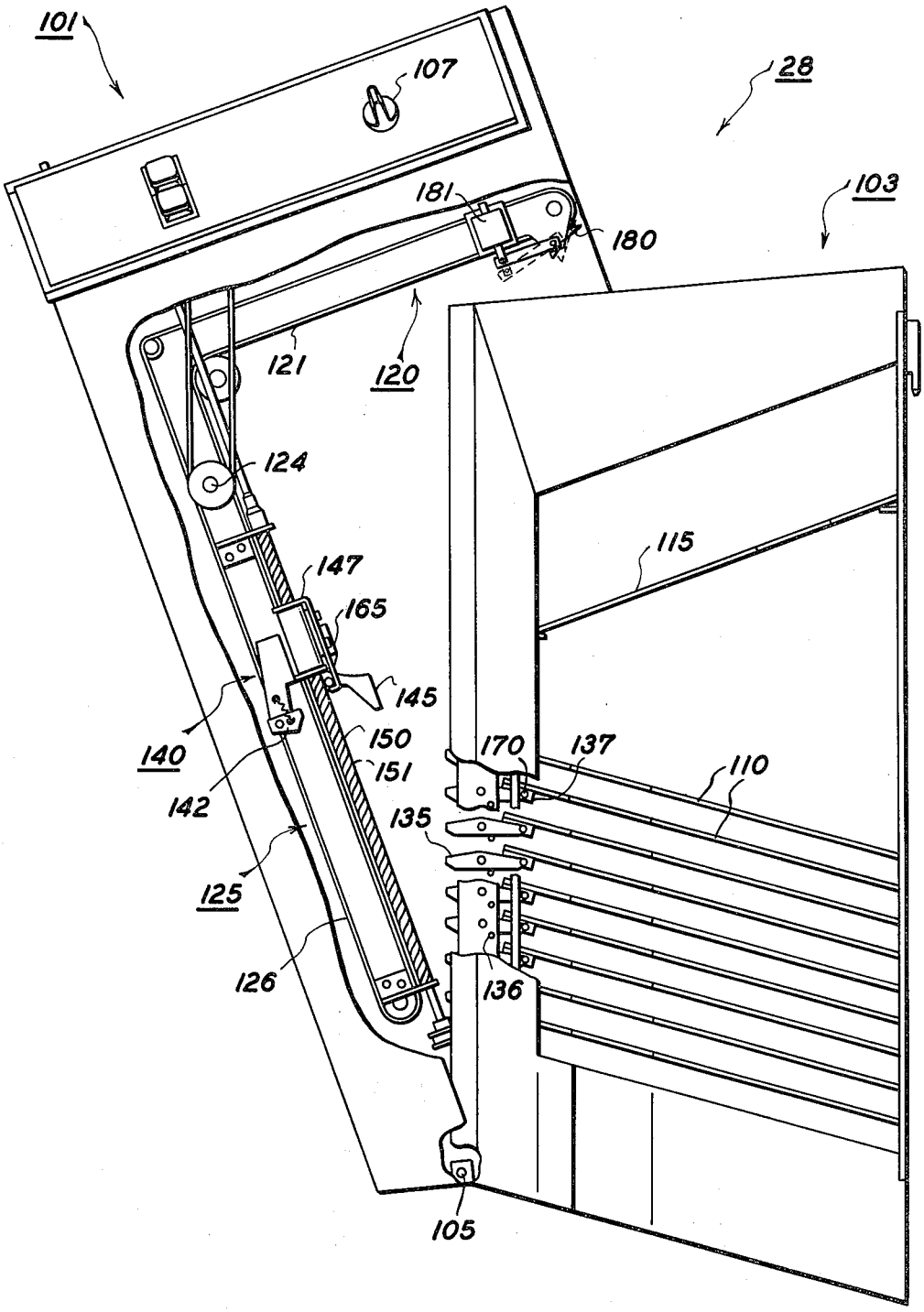
FIG. 3 is a view similar to FIG. 2 with the apparatus in an opened position.

As shown schematically in FIG. 1 the electrostatographic reproducing system comprises a document feeding apparatus 22, positioned on a xerographic processor 25 which transport copy sheets to a sorting apparatus 28 for sorting in accordance with the invention. A control panel 32 includes the usual counters and buttons as well as button S1 for START PRINT, S2 for sorter ON and S3 for sorter OFF. The processor includes a drum shaped surface 40 including a photoconductive backing. This surface is mounted on a shaft journaled in a frame to rotate in the direction of the arrow to cause the drum surface sequentially to pass a plurality of xerographic processing stations.

For the purpose of the present disclosure, the several xerographic processing stations in the path of movement of the drum surface may be described functionally as follows:

A charging station A, at which a uniform electrostatic charge is deposited on the photoconductive layer of the xerographic drum;

An exposure station B, at which a light or radiation pattern of copies to be reproduced is projected onto the drum surface to dissipate the drum charge in the exposed areas thereof and thereby form a latent electrostatic image of the copy to be reproduced;

A developing station C, at which a xerographic developing material including toner particles having an electrostatic charge opposite to that of the electrostatic latent image are cascaded over the drum surface, whereby the toner particles adhere to the latent electrostatic image for a xerographic powdered image in configuration of the copy being reproduced;

A transfer station D, at which the xerographic powder image is electrostatically transferred from the drum surface to a transport sheet material or drum surface;

A drum cleaning and discharge station E, at which the drum surface is brushed to remove residual toner particles remaining thereon after image transfer, and at which the drum surface is exposed to a relatively bright light source to effect substantially complete discharge of any residual electrostatic charge remaining thereon, and A fusing station F, at which the powder image is permanently affixed to the sheet material which is transported to sorting apparatus 28.

For a more detailed description of the copy processing stations reference is had to U.S. Pat. No. 3,301,126 to Osborne et al., which is commonly assigned.

Referring now to FIGS. 2 – 6 the sorting apparatus 28 includes modular assemblies 101 and 103. Assembly 101 is positioned on the outside and is hinged to pivot on an axis through a mounting 105 upon turning knob 107. Modular assembly 103 is secured inside to the end frame of processor 25. Assembly 103 includes bins or trays 110 which receive the copy sheets printed from documents fed from document feeding apparatus 22. Also included is a main or overflow tray 115 which is used in the non-sort mode of operation or as an overflow for the sort-mode of operation as will be explained more fully hereinafter.

Modular assembly 101 houses horizontal transport 120 and vertical transport 125 which incorporates a vacuum to advance copy sheets from the processor into the sorting bins 110. Transport 120 includes belts 121 which are driven by a shaft 124. Transports 125 includes belts 126 which are also driven by shaft 124. Shaft 124 is driven from a main drive motor 129 mounted in assembly 101. Transport 120 is mounted to the transport 125 via bearings on common shaft 124. Vacuum is provided through holes of transport belts 121 and 125 via a centrifical type blower or the like (not shown) which is driven by main drive motor 129.

Bins 110 are closely spaced and are adapted to be raised into an open position to enable a reliable feed-in of the copy sheets. The bins 110 are vertically positioned one above the other and are angled down and away from the transport 125 at an angle of approximately 15°. In this manner the copy sheets moving downward on the transport 125 are directed into each of the bins by a movably mounted bin feeder and lifting device 140. Bins 110 are received through slots 132 formed in the frame and are secured to the frame by a common retaining plate 133. Plate 133 engages a tongue portion 134 of each bin 110 to retain the bins while enabling pivotal movement relative to the frame. At the inlet of each bin 110 is a pair of pivotal fingers 135 which are received in slides 137 to the bins.

Bin feeder and lifting device 140 includes a pair of finger actutating cams 142 which translate along the sheet path between the vertical extend of the bins. Cams 142 are secured to a carriage 147 which extends along the width of the transport 125. Carriage 147 is driven by two helix screws 150 and 151 driven by a motor spring (FIG. 6) to guide the carriage from the top to the bottom bin. The motion is stepped or intermittent from bin to bin upon a single revolution of a latched device 162 which is released by a solenoid signal from a switch 165 indicating the trail edge of the sheet has passed and the sheet is entering the bin. An electromagnetic clutch 163 is driven by main drive motor 129 upon a signal from the processor provides the opposite direction motion for the reset of the carriage at the bin at the bottom. It is during this rewind movement that the motor spring 160 is again tensioned. The step rotation of the screws 150, 151 effects the vertical movement of the carriage and fingers along the vertical transports 125 at the inlets of the bins.

Bins 110 are pivotally mounted and rest on top of fingers 135. Pivoting into an opened feed-in position is accomplished by cams 142 as they move downwardly causing the previous or upper bin to pivot upwardly as the cams strike the fingers 135 which are pivotally mounted resting on stop pins 136 on assembly 103. Simultaneously each copy sheet is directed into the appropriate bin by the action of deflector members 145 mounted on the carriage. Cams 142 are pivotable to rotate around the fingers during reset of the carriage.

In operation the sorting apparatus of the invention has two modes of operation. Upon depressing switch button S3 the sorter is off with all copies delivered to the main tray 115 by deflector fingers 180 on assembly 101 as shown by the dotted lines in FIG. 33. For the sorting mode of operation deflector fingers 180 are activated by a solenoid 181 by pressing switch button S2 and copy sheets exiting from the processor are directed onto the underside of the transport 120. Copy sheets are advanced horizontally by the transport 120 and then turned at an angle about 80° downwardly onto the transport 125. Copy sheets moving downwardly on transport 125 are directed into bins 110 by the bin feeder and lifting device 140 which is stepped along the inlets of the bins 110. At the same time the previous bin is pivoted open and the copy sheet deflected thereon. In the event that there is an excess number of copies for the bins or a jam the sheets are automatically fed into tray 115 which serves as an overflow tray due to the de-energization of solenoid 181 which results in the deflector fingers resuming their normal position to deflect the sheets to tray 115.

While there have been shown and described and pointed out the fundamental novel features of the invention as applied to a preferred embodiment it will be understood that various omissions and substitutions and changes in the form and details of the device illustrated and its operation may be made by those skilled in the art without departing from the spirit of the invention.

What is claimed is:

1. In a copying machine which produces multiple copy sheets of document information, an improved sheet sorting apparatus for stacking copies in collated sets comprising:

a frame associated with a copying machine;

a first modular assembly secured to the frame including a plurality of bins arranged in a vertical array for receiving copy sheets, a second modular assembly including sheet transport means having substantially horizontal and vertical conveyors positioned adjacent to said first assembly for transporting sheets horizontally and then vertically along the inlets of each of the bins, said second assembly being pivotally mounted to move from a first position when in a sorting mode of operation to a second position in a direction away from said first assembly to provide access to said sheet transport means and bin inlets for jam clearance thereof.

2. Apparatus according to claim 1 including an overflow bin positioned above said bins and wherein said first assembly includes deflector fingers actuatable to a first position to direct sheets immediately into the overflow bin or a second position to direct sheets onto said horizontal conveyor.

3. Apparatus according to claim 1 including an overflow tray positioned above said bins to receive copies deflected from said transport means by deflector fingers associated therewith.

4. Apparatus according to claim 3 including a sheet feed means which moves vertically along the path of the vertical conveyor for deflecting the sheets into each of the bins.

* * * * *